US006511558B1

(12) United States Patent
Utyashev et al.

(10) Patent No.: US 6,511,558 B1
(45) Date of Patent: Jan. 28, 2003

(54) METHOD FOR PRODUCING VEHICLE WHEELS

(75) Inventors: Farid Zainullaevich Utyashev; Oscar Akramovich Kaibyshev; Vadim Gennadievich Trifonov, all of Ufa (RU)

(73) Assignee: General Electric Company, Niskayuna, NY (US)

( * ) Notice: Subject to any disclaimer, the term of this patent is extended or adjusted under 35 U.S.C. 154(b) by 0 days.

(21) Appl. No.: 09/719,669

(22) PCT Filed: Jun. 24, 1999

(86) PCT No.: PCT/US99/14457

§ 371 (c)(1),
(2), (4) Date: Dec. 14, 2000

(87) PCT Pub. No.: WO99/67042

PCT Pub. Date: Dec. 29, 1999

(30) Foreign Application Priority Data

Jun. 24, 1998 (RU) ..... 98111967

(51) Int. Cl.[7] ..... C21D 7/13

(52) U.S. Cl. ..... 148/583; 148/654; 29/527.7; 29/894.3

(58) Field of Search ..... 148/583, 649, 148/654; 29/527.7, 159, 894.3

(56) References Cited

U.S. PATENT DOCUMENTS 4,579,604 A 4/1986 Bever ..... 148/12.7 A
4,624,038 A 11/1986 Walther ..... 29/159.01
4,936,129 A 6/1990 Lipper ..... 72/68

FOREIGN PATENT DOCUMENTS

| | | |
|---|---|---|
| JP | 05287467 | 2/1993 |
| SU | 181457 | 5/1993 |
| SU | 1814579 | 5/1993 |
| WO | 9748509 | 12/1997 |

OTHER PUBLICATIONS

Derwent WPI XP–002120329, Week 199430.
Pat. Abs. Japan, v. 018, No. 082 (C–1164); JP 05–287467, Nov. 2, 1993.

*Primary Examiner*—Deborah Yee
(74) *Attorney, Agent, or Firm*—Noreen C. Johnson; Christian G. Cabou

(57) ABSTRACT

A metal forming method is used for manufacturing vehicle wheels. The invention comprises manufacturing of a wheel block comprising a central part and initially formed rim; drawing of the rim by hot rolling to obtain a wheel profile that approximates a finished wheel, and a final wheel treatment process. The rolling is conducted from either side of the wheel block, which may comprise any granular microstructure. Rolling temperature-strain rate conditions correspond to the microstructure. For a coarse-grain microstructure, the rim includes a shoulder with a thickness greater than that of the finished wheel, and thickness differences transform the microstructure into a recrystallized and/or polygonized microstructure. For a fine-grain microstructure, the rim includes a shoulder or flange with a thickness close to a thickness of a finished wheel. For mixed microstructures, the rim includes a shoulder and has a thickness greater or equal to a finished wheel.

16 Claims, 5 Drawing Sheets

METHOD FOR PRODUCING VEHICLE WHEELS

BACKGROUND OF THE INVENTION

The invention relates to the pressure treatment of metals. In particular, the invention relates to manufacturing of different types of wheels, including wheels for vehicles, for automobiles, and aircraft, as well as rollers for the crawler-belt vehicles.

One known method for manufacturing of wheels utilizes die casting. This method exhibits high productivity and low cost. It provides for reliable operation of wheels so produced when the wheels are used on high quality roads, such as roads with a hard coating. However, mechanical properties of the alloys with a die cast structure are not adequate for wheels used on roads with coatings of poor quality, in sports cars, and heavy-weight vehicles. In addition, alloys with the die cast structure have a lesser specific strength as compared to alloys with a deformed structure. Therefore, wheels made by a die casting method typically are heavier than wheels made by forging.

Another known method for manufacturing of wheels utilizes forging. According to this forging method, a wheel is produced in several steps. The first step involves fabrication of a wheel block by forging. The central part of the wheel block comprises a hub, web, and a part of the rim having a collar. Another part of the wheel block comprises an initially-formed rim that comprises a cylindrical shoulder. The volume of the shoulder is generally equal to or more than the volume of the rim of the finished wheel. In a next step of a forging manufacturing process, a rim is rolled onto a mandrel. The final step using a forging process involves a calibration of the rim.

However, this method of the manufacturing using a forging method has limited applicability because the initial wheel block has to be of a specific design (configuration). Also, the conditions for hot rolling are not optimized by considering structure and mechanical properties of the initial wheel block. These disadvantages limit the process yield and lead to large amounts of metal scrap. For example, when hot rolling is applied to a wheel's cylindrical part with a diameter that is generally equal to the diameter of the mandrel, the unrolled part of the rim is constantly displaced. In addition, a surface, which contacts with the mandrel, is subjected to the friction forces, and thus, the hot rolling based requires additional equipment capacity and requirements. It is necessary that the equipment decrease the speed of hot rolling, and allow additional stock to be added to avoid creation of necks (zones with smaller thickness) in rolled or intermediate parts of the wheel. Also, it is necessary that an additional calibration step, in conjunction with other steps in this method, be used in the process to solve the associated problems. The additional calibration steps increase the manufacturing time for wheel production, and adds to labor costs. Further, the additional calibration steps typically lead to an increased metal consumption, which is caused by a difficulty of the calibration of a wheel solely by means of a local metal redistribution. For example, thinning and thickening of certain wheel regions leads to displacement of metal portions beyond the formed wheel profile, similar to a flash during an open forging.

These and other aspects, advantages and salient features of the invention will become apparent from the following detailed description, which, when taken in conjunction with the annexed drawings, where like parts are designated by like reference characters throughout the drawings, disclose embodiments of the invention.

DESCRIPTION OF THE INVENTION

Figure 1:
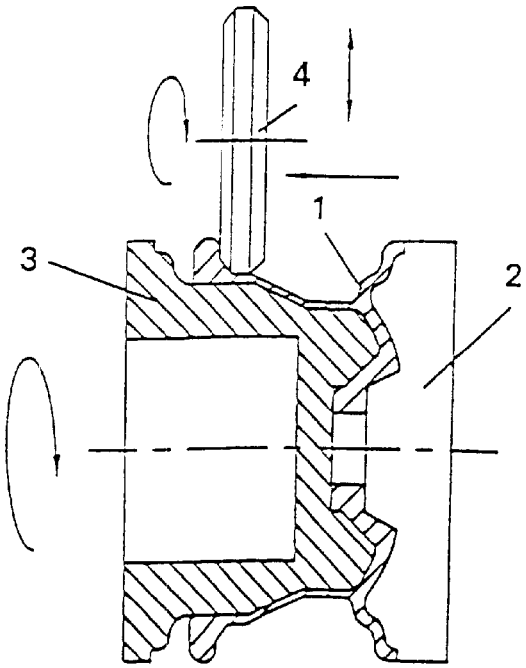
FIG. 1 illustrates a system for the hot rolling of a wheel block having a coarse-grain microstructure, in which the wheel block has a shoulder on the outer side.

Wheels, which are manufactured utilizing a method of plastic deformation as embodied by the invention, for example a hot rolling method for plastic deformation, exhibit favorable final wheel mechanical properties. This invention beneficially provides for an expansion of technological capabilities for wheel manufacturing, increase in the productivity and quality, and decrease of manufacturing costs. These benefits are conducted, at least in part, by applying a new method for manufacturing of wheels for vehicles.

The method, as embodied by the invention, comprises manufacturing a wheel block that comprises a central part of a wheel, intermediate parts, and an pre- or initially-formed rim, drawing of the rim by hot rolling to obtain a profile that is close to the profile of a finished wheel, and a final treating of the wheel.

The rolling of at least a part of, and alternatively all of, a rim is accomplished from either an inner or outer side of the wheel block, in which the wheel block may comprise any grain microstructure. Temperature-strain rate conditions of the rolling should correspond to the grain microstructure of the wheel block. In order to accomplish this during manufacturing of the wheel block, shape and size of the rim correspond to wheel structures that will be formed. For a coarse-grain microstructure, such as that which results from a casting process, the shape of the rim includes a shoulder with its thickness greater than that of the finished wheel. Any difference in thickness is sufficient for transformation of this microstructure into an at least one of a recrystallized and polygonized microstructure in most of the rim, as a result of drawing and, alternatively in conjunction with, a heat treating. For a fine-grain microstructure, the shape of the rim can also comprise a shoulder or a flange with a thickness that is close to that of the finished wheel.

For mixed grain microstructures, which can include partially recrystallized, polygonized, and cast microstructures, the shape of the rim includes a combination of a shoulder, intermediate wheel portions, and a flange with a thickness, that is greater or equal to that of the finished wheel. For a rim with the coarse-grain microstructure, the diameter of a surface, which faces a mandrel, differs from a diameter of a working surface of the mandrel. The difference in diameters provides for sliding of the wheel block onto the mandrel. The hot rolling is thus accomplished by at least a single transition (step).

In practicing the method, as embodied by the invention, the following technological, exemplary approaches are envisioned. During manufacturing of a wheel block by a casting method, the rim is formed in the shape of a cylindrical shoulder with the thickness that is from two to five times greater than a thickness of the finished wheel. The diameter of the wheel block surface that faces the mandrel differs for not more than 2% of the diameter of the mandrel's working surface. The temperature for the hot rolling process is in a temperature range from 0.6 to 0.88 of the melting temperature, $T_{melt}$. The strain rate for the hot rolling process is in a range from $10^{-3}$ to $10^{1}$ $s^{-1}$.

The wheel block can be produced by forging at (0.6–0.88) $T_{melt}$ and a strain of not less than 60%. A rim is made in a shape that comprises a flange wit h the thickness of 1.1–1.5 times greater than a thickness of the finished wheel. The hot rolling of the rim is performed at a temperature that is not higher than the forging temperature and at a strain rate of $10^{-1}$–$10^{2}$ $s^{-1}$ by a projection of the rim disposed into the mandrel.

The wheel block can be produced, as embodied by the invention, by forging process at (0.6–0.88) $T_{melt}$ and strain of 40–50%. The rim comp rises a cone-shaped flange, such as a plate, having an angle of inclination to the axis of 30°–45° and a thickness of 1.6–2.0 times greater than a thickness of the finished wheel. The hot rolling of the rim is conducted at a temperature not higher than the temperature of forging at a strain rate of $10^{-1}$–$10^{1}$ $s^{-1}$. For wheels with a double-sided rim, the hot rolling of an initially formed rim is conducted in a single step or transition in each direction using two coaxial mandrels.

Further, a wheel block can be manufactured, as embodied by the invention, by forging at (0.6–0.88) $T_{melt}$ and strain of 40–50%. The rim is manufactured as a combination of a flange and shoulder. The shoulder faces a short part of the rim relative to its central part. The hot rolling process is conducted on two coaxial mandrels in a single transition (step) in each direction at a temperature that does not exceed the temperature of forging and at a strain rate of $10^{-1}$–$10^{1}$ $s^{-1}$. The rolling of the flange is conducted by projection being disposed into a mandrel.

The wheel block can also be produced, as embodied by the invention, by a casting process. The rim comprises a cone-shaped flange having an angle of inclination to the axis of 20°–25° and a thickness of 2–2.5 times greater than a thickness of a finished wheel. The hot rolling of the rim is conducted in two transitions. The first transition is done on a smooth mandrel down to thickness of 1.1–1.5 at (0.6–0.88) $T_{melt}$ and strain rate of $10^{-2}$–$10^{-1}$ $s^{-1}$. The second transition is done at the temperature not exceeding the temperature of the first transition and at a strain rate of at least $10^{-1}$ $s^{-1}$.

A wheel block, as embodied by the invention, can be produced by a forging process from a billet, in which the billet includes a fine-grain structure, with an average grain size not exceeding 15 $\mu$m. This fine-grain structure comprises at least 50% of the billet's volume. A forging step is performed in isothermal conditions at a strain rate of $10^{-1}$–$10^{4}$ $s^{-1}$.

During the final treating step, heating of the wheels for a quenching process can be combined with heating of the wheel blocks for hot rolling. Heating of the wheel blocks for hot rolling can be combined with heating of the billets for forging.

Alternatively, for the final treating, heating of the wheels for quenching can be combined with heating of the billets for hot rolling.

Forging is typically conducted with the strain rates ranging from $10^{1}$ to $10^{4}$ $s^{-1}$. These strain rates provide enhanced, and often maximum, dynamic and spontaneous recrystallization.

The hot rolling is generally conducted on a mandrel, which has its working surface temperature equal to a deformation temperature of the wheel. The billet may be heated to a temperature lower than the temperature of deformation. Alternatively, the hot rolling is performed on a mandrel, which has its working surface temperature of lower than the temperature of deformation.

The above described methods, as embodied by the invention, expand the technological methods for wheel manufacturing from wheel blocks with different microstructures and structures. These different microstructures and structures are obtained by several methods, which can include casting, hot deformation, and powder metallurgy methods. In turn, these methods are accomplished by applying several technological approaches, such as hot rolling using preset thermo-mechanical conditions based on the wheel block final structure, for example its shape and size.

In a wheel block that will be manufactured by a casting process, the shape and thickness of its rim are selected to provide a structure with adequate mechanical properties after hot rolling. This structure with adequate mechanical properties is conducted by selection of a rim with a shape of a shoulder. The shoulder thickness is 2–5 times greater than the rim thickness of a finished wheel. In addition, the wheel block is fit to the mandrel with a minimal gap fit therebetween, and alternatively with a small interference fit therebetween. This fit leads to an increase in friction forces therebetween during movement of the wheel block on the mandrel. Consequently, a greater shift deformation is possible. In turn, this process leads to formation of the polygonized or recrystallized microstructure in the wheel after at least one of deformation and further heating for quenching. To improve the process of the transformation of the microstructure, the deformation temperature it at (0.6–0.88) $T_{melt}$, with a strain rate of $10^{-3}$–$10^{1}$ $s^{-1}$.

During drawing steps, a thickness of the flange is 2–5 times greater than thickness of the finished wheel. This thickness provides a required level of deformation treatment and consequently improves the mechanical properties of the finished wheel. As a result, the finished wheel has a rim that is subjected to a higher impact stress, and exhibits enhanced properties than a central part of the finished wheel.

The fit of a wheel block with a minimal gap fit and alternatively an interference fit, slows down the hot rolling process. In a die cast structure, however, friction forces between a wheel block and mandrel improve the stressed condition thereof, which leads to an increase of the wheel block deformation capability. Thus, an economic benefit is provided by manufacturing of the wheel block using a simple, productive method, such as die casting.

A wheel block, as embodied by the invention, that is manufactured by a forging process, results in a microstructure with high levels of mechanical properties. Several factors in the forging method provide minimal contact friction between adjoining parts, in comparison with previously described methods of the manufacturing of wheel blocks. These factors include a flange shape of the wheel block; a smaller thickness of the flange that is typically only 1.1–1.5 times greater than the thickness of the finished wheel; a fit of the wheel block to the mandrel with a relatively large gap; and hot rolling, for example, by projection of the flange into the mandrel, as a roll presses a flange against the mandrel. The existence of a deformed structure in the wheel block can increase a rolling speed due to a decrease of stress flow in the material and its greater plasticity. Thus, the finished wheel quality is enhanced by forging and hot rolling processes, as embodied by the invention. Cost reductions are resulting by using a process, as embodied by the invention.

A shoulder shape of a wheel block has been discussed in the description of the invention. A forged wheel block is more expensive than a finished wheel that is manufactured by casting because of costs associated with hot rolling. The process, as embodied by the invention, combines hot rolling with a low cost casting of the wheel block. Alternatively, the process, as embodied by the invention, combines a forged wheel block with a less expensive hot rolling process. Thus, the combination of features makes this process, as embodied by the invention, economically attractive for forming any wheel block structure. Therefore, a selection of deformation conditions according to a desired structure for a wheel block provides a finished wheel with a high quality and desired characteristics. For the wheels with a double sided rim, it is desirable to provide high-level, mechanical properties on both sides of the rim. Thus, hot rolling is provided during a single step or transition on two co-axial mandrels.

The starting materials for a wheel block may vary. As discussed above the starting material is selected with a microstructure corresponding to a desired microstructure of the final wheel. Examples for materials within the scope of the invention will now be discussed. These examples are merely exemplary, and are not meant to limit the invention in any manner.

For starting materials with a coarse-gain microstructure, a strain rate is selected to be less than $10^{-1}$–$10^{1}$ $s^{-1}$. For a fine-gain microstructures, a strain rate is selected to be greater than $10^{-1}$–$10^{2}$ $s^{-1}$.

If a starting material comprises a coarse-gain microstructure that exhibits a low plasticity, which leads to cracks and degradation of material during the hot rolling, a rim is manufactured in a shape of a conic flange, and is treated in two steps. At a first step, the conic flange is rolled, for example by rolling on a conic mandrel. At a second step, the rim is finished by being formed by projection of the initial conic flange onto a mandrel having the desired final wheel shape. This treatment decreases strain rates during the first step when an alloy has the a coarse-grain structure, and avoids the possibilities of material defects and degradation in both steps.

If the starting material comprises fine grain microstructures in a wheel block billet prior to forging and the fine grains comprise at least 50% of the billet's volume, fine grains create deformation under conditions of superplasticity. These conditions are provided by temperature of (0.6–0.88) $T_{melt}$ and strain rates of $10^{-1}$–$10^{-4}$ $s^{-1}$. The use of deformation under superplasticity conditions reduces energy consumption during forging that would typically be related to equipment capacity. The use of deformation under superplasticity conditions also provides for shaping part of the rim, which is formed during hot rolling, as close as possible to the finished wheel shape. This deformation under superplasticity conditions also reduces the amount of metal rolled by a roller and, in general, reduces labor costs.

Implementation of operations for shaping and quenching during one heating procedure decreases the working cycle time for wheel manufacturing. The temperature range of the highest plasticity of the alloys with fine gain structure, for example Al-based alloys, shifts to the temperature range into higher temperatures. This leads of the temperature range that possibly permits deformation without degradation and at temperatures employed for heating and for quenching.

Forging in a temperature range of (0.7–0.88) $T_{melt}$ and with a strain rate of $10^{-4}$–$10^{-1}$ $s^{-1}$ provides dynamic recrystallization of the material. This dynamic recrystallization allows a fine gain microstructure to form in an alloy. Existence of this fine grain recrystallized microstructure increases strain rate during hot rolling, and thus reduces energy consumption. Existence of the fine grain microstructure in the finished wheel provides better mechanical properties therein.

The most widely used materials for wheel manufacturing are aluminum alloys. However, the disclosed technological processes can be used for wheel production from a material selected from titanium- and barium-based alloys.

FIGS. 1–7 illustrate the following parts, as embodied by the invention: wheel block 1; holder 2; mandrel 3; roll 4; second mandrel for rolling in both directions 5. On the wheel blocks illustrated and showed in FIGS. 8–12, forging and casting inclinations are not specified, but are readily discernible from the figures.

Application examples, as embodied by the invention, will now be discussed. These examples are merely exemplary and are not meant to limit the invention in any manner.

Example 1

The wheel blocks for hot rolling comprise AB alloy and are formed by a die casting process so the wheel blocks' possess a coarse grain microstructure. The grain size is in a range from 5,000–10,000 $\mu$m. The wheel blocks were manufactured with a rim in the shape of a cylindrical shoulder (for example see FIG. 8) having a thickness of 25 mm. The diameter of the rim results in the wheel block being fit to a mandrel having a diameter of 283 mm. A gap between the rim and mandrel was 0.1–0.2 mm. The hot rolling process was conducted in a single transition (step) on the outer side in one direction at a temperature of 440–460° C., at strain rate of $10^{-2}$–$10^{-1}$ $s^{-1}$, and strain 60%–70% in accordance with the system of FIG. 1. The hot rolling process was conducted for 7 minutes. A heat treating was performed thereafter, and included quenching followed by an artificial aging step. The hot-rolled wheels were then subjected to a mechanical treatment. The finished wheel, as embodied by the invention, that are produced according to the above-described process and system, as embodied by the invention, exhibit a defect-free deformed microstructure.

Example 2

The wheel blocks for hot rolling comprise ABr alloy and are manufactured by hot forging process under conditions of superplasticity at a temperature of 510–520° C. and a strain rate of $10^{-2}$–$10^{-3}$ $s^{-1}$. These wheel blocks, in accordance to Example 2, were manufactured from a billet that exhibited a grain size not more than 15 $\mu$m. This microstructure constituted about 80% of the billet volume. Each wheel block was formed with a rim having a flange with a thickness of 12 mm (FIG. 9). The wheel blocks were installed onto mandrels without cooling or extra heating. Hot rolling was conducted in a single transition (step) on an outer side of the wheel block in one direction with the projection of the rim facing the mandrel. The strain rate was $10^{-1}$–$10^{2}$ $s^{-1}$ and average strain was 20%. This procedure was performed in accordance with the system of FIG. 2. Hot rolling time was 1.5 minutes. After a shape forming process, the manufactured wheel was subjected to a quenching cooling, followed by an artificial aging and mechanical treatment, to result in a finished wheel.

Example 3

The wheel blocks for hot rolling comprise AB alloy and are manufactured by die casting. The wheel blocks exhibit had a coarse-grain microstructure with the gain size of 5,000–10,000 $\mu$m. These wheel blocks were manufactured to include a rim comprising a cylindrical shoulder with a thickness of 25 mm (as illustrated in FIG. 8). The diameter of the rim is configured so that the wheel block, when fit to the mandrel having a diameter of 283 mm, provides a gap between the rim and the mandrel in a range from 0.1–0.2 mm. The hot rolling was conducted in a single transition (step) on an inner side in one direction at a temperature of 440–460° C., with a strain rate $10^{-2}$–$10^{-1}$ $s^{-1}$, and strain of 60–70%. This procedure was performed in accordance with the system of FIG. 3. The hot rolling time was 6 min. After hot rolling, heat treating was performed and included quenching followed by an artificial aging. The hot rolled wheels were then subjected to mechanical treatment. The wheels produced according to the above-described system and process exhibited a defect-free deformed microstructure.

Example 4

Figure 4:
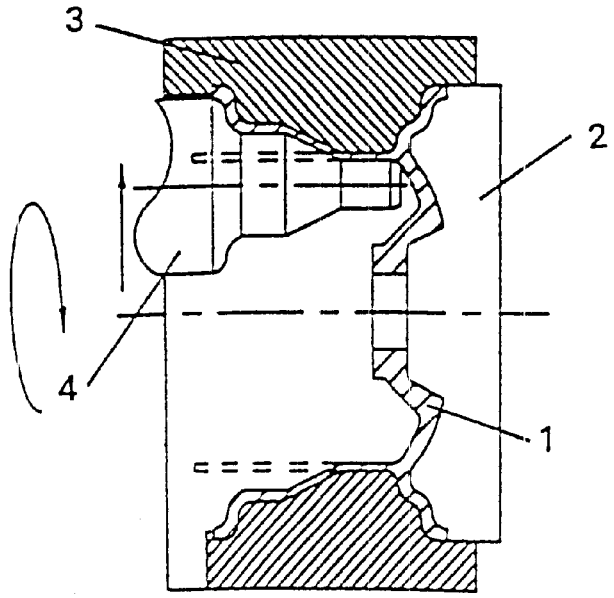
FIG. 4 illustrates a system for the hot rolling of a wheel block having a fine-grain microstructure, in which the wheel block has a long shoulder on the inner side.
Figure 5:
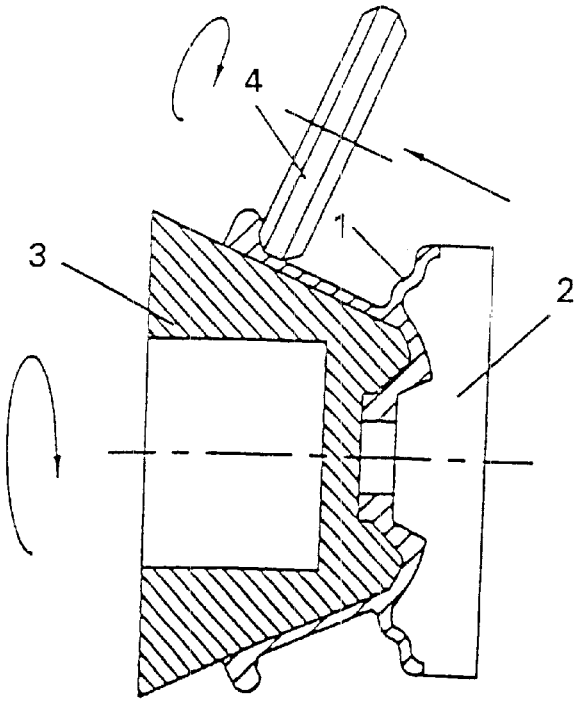
FIG. 5 illustrates a system for the hot rolling of a wheel block having a coarse-grain microstructure in which the wheel block has a shoulder on the first transition on the outer side onto a smooth conic mandrel.
Figure 6:
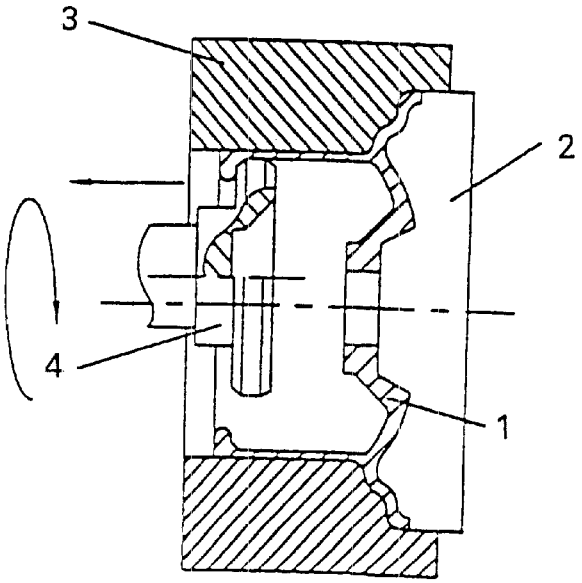
FIG. 6 illustrates a system for the hot rolling of a wheel block having a coarse-grain microstructure in which the wheel block has a shoulder on the first transition on the inner side onto a smooth cylindrical mandrel.

As embodied by the invention, the wheel blocks for hot rolling comprise AMr6 alloy and are formed with a rim having a shoulder (as illustrated in FIG. 4, dotted line). The wheel blocks possess a thickness of 12 mm obtained by a hot forging process at a temperature of 420–450° C. and an average strain rate of $10^{-2}$ $s^{-1}$. As the result of a dynamic recrystarization, the fine-gain microstructure formed in the alloy had an average grain size of 10–15 $\mu$m. A hot rolling process was performed in a single transition (step) on an inner side in one direction by a projection of the wheel block rim disposed onto a mandrel with the strain rate of $10^{-1}$–$10^{2}$ $s^{-1}$, according to the system illustrated in FIG. 4. The hot rolling time was 1 minute. The hot rolled wheels were then subjected to the mechanical treatment to result in the finished wheels.

Example 5

The wheel blocks, as embodied by the invention, for hot rolling comprise AB alloy, and are formed with a rim having a shape of conic flange, and a thickness of 25 mm, with an angle to the axis of 20–25° (as illustrated in FIG. 12). The wheel blocks are manufactured by a die casting process and were rolled in two transitions (steps). During the first transition, hot rolling was performed on an outer side in one direction on a smooth mandrel (see FIG. 5) at a temperature of 450° C. with a strain rate of $10^{-2}$ $S^{-1}$ thus reducing the wheel block down to a thickness of 12 mm. During the second transition, the rim was hot rolled on its outer side in one direction by a projection onto the mandrel, which comprised the shape of a finished wheel (see FIG. 2). The second transition was conducted at a temperature of 440° C. at strain rate of $10^{-1}$ $s^{-1}$. The hot rolled wheels were then subjected to a heat treating (which included quenching and artificial aging), as well as mechanical treatment to result in the finished wheel.

Example 6

The wheel blocks for hot rolling comprise AB alloy and are manufactured by die casting, as embodied by the invention. The wheel blocks include a coarse-grain microstructure with a grain size of 5,000–10,000 $\mu$m. These wheel blocks were manufactured with a rim in the shape of a cylindrical shoulder, which has a thickness of 25 mm (see FIG. 8). The diameter of the rim is configured and produced so as the wheel block is fit to a 283 mm diameter mandrel, a gap is formed between the rim and the mandrel is in a range from 0.1–0.2 mm. The hot rolling was conducted in two transitions (steps) on the inner side. During the first transition, the wheel block was rolled on a smooth mandrel at a temperature of 440–460° C., strain rate of $10^{-2}$–$10^{-1}$ $s^{-1}$, and strain of 60–70%. The procedure was performed in accordance with the system of FIG. 6. The rolling time was 6 minutes. During the second transition, the hot rolling was performed by the projection, as illustrated by FIG. 4, with a strain rate of $10^{-1}$–$10^{2}$ $s^{-1}$. The total hot rolling time was 7 min. After the hot rolling, a heat treating was performed on the wheel block, in which the heat treating included quenching followed by an artificial aging. The hot rolled wheels were subjected to mechanical treatment to result in the finished wheel.

Example 7

Figure 7:
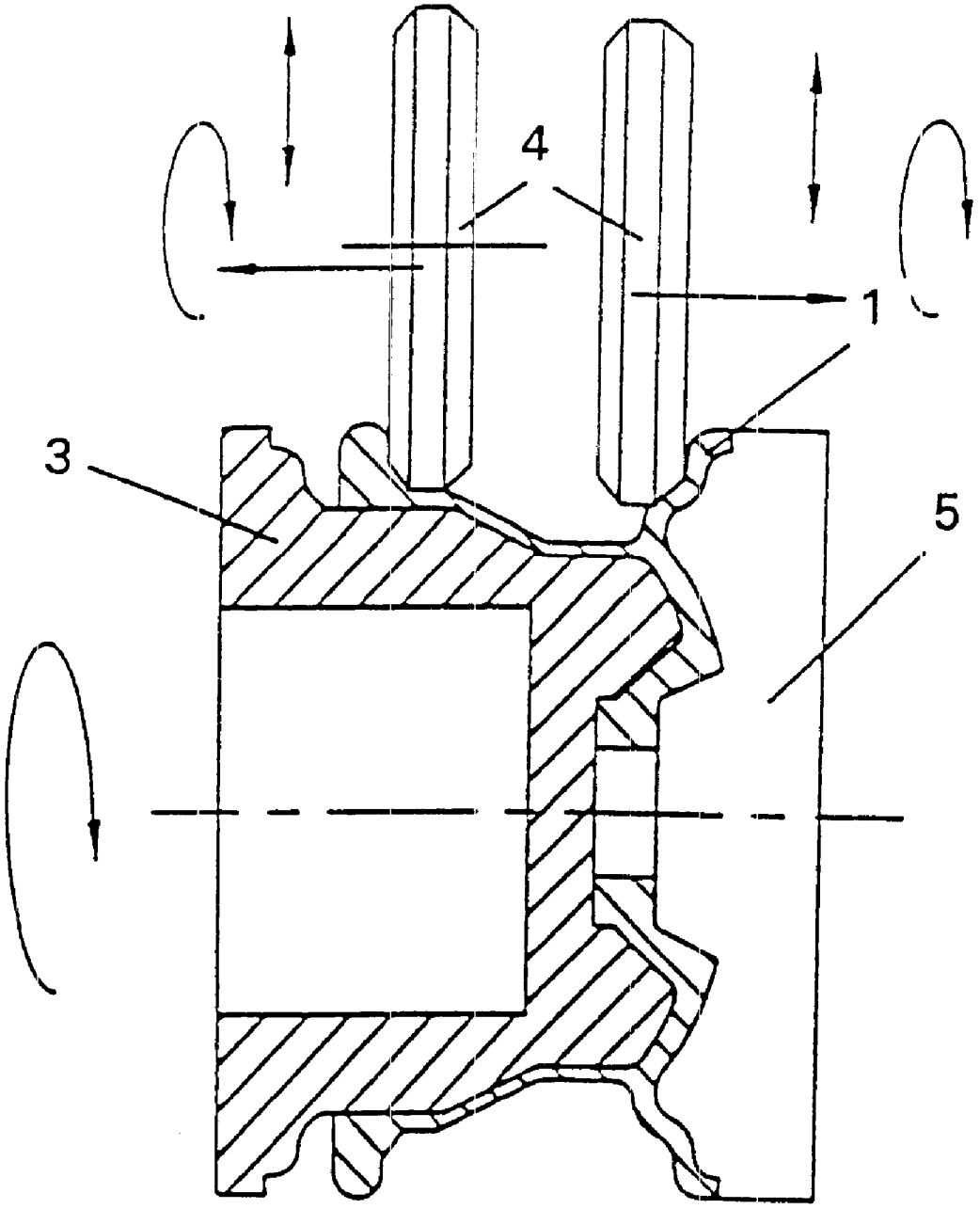
FIG. 7 illustrates a system for the hot rolling of a wheel block having a coarse-grain microstructure in two directions on an outer side.
Figure 8A:
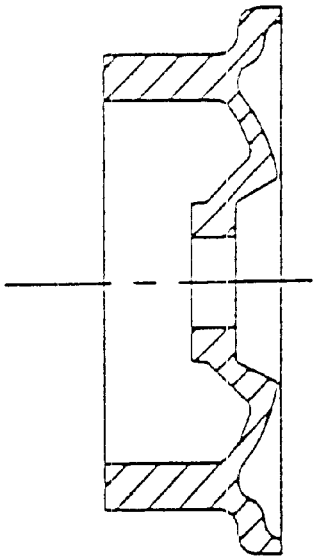
FIG. 8*a* illustrates a wheel block having a coarse-grain microstructure in which the wheel block has a shoulder on the outer side for hot rolling in one direction.
Figure 8B:
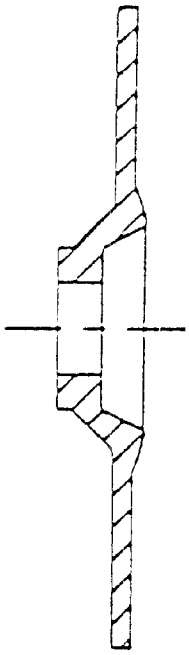
FIG. 8*b* illustrates a wheel block having a fine-grain microstructure in which the wheel block has a flange on the outer side for hot rolling in one direction.
Figure 8C:
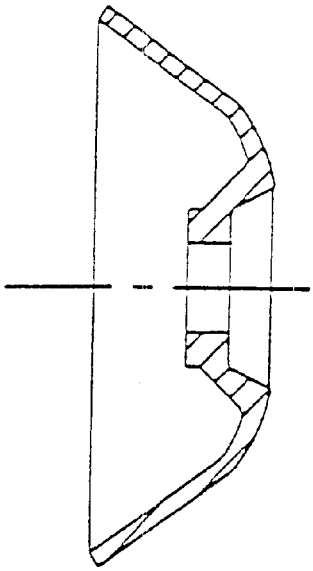
FIG. 8*c* illustrates a wheel block having a mixed-grain microstructure in which the wheel block has a flange on the outer side for hot rolling in one direction.
Figure 8D:
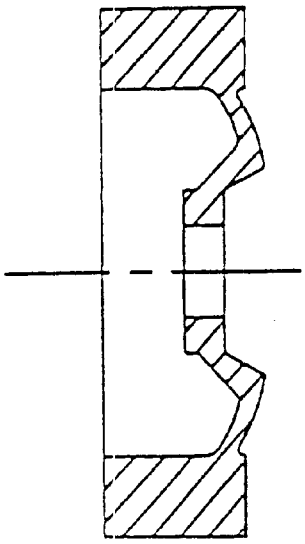
FIG. 8*d* illustrates a wheel block having a coarse-grain microstructure in which the wheel block has a shoulder on the outer side for hot rolling in both directions.
Figure 8E:
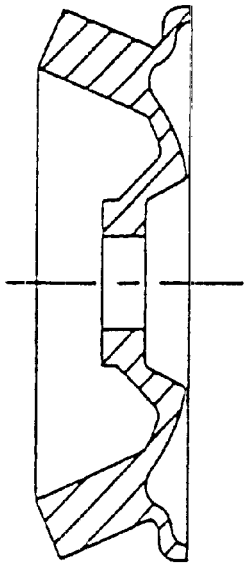
FIG. 8*e* illustrates a wheel block having a coarse-grain microstructure in which the wheel block has a shoulder on the outer side for hot rolling at the first transition in one direction.

The wheel blocks for hot rolling comprise AMr6 alloy. The wheel blocks comprise a rim in a shape of a shoulder with thickness of 25 mm (see FIG. 11). The wheel blocks are manufactured by die casting. The diameter of the rim is configured so as the wheel block is fit to the 283 mm diameter mandrel, a gap formed between the rim and the mandrel was in a range from 0.1–0.2 mm. The hot rolling is conducted on an outer side in both directions on co-axial mandrels, as illustrated in FIG. 7. The co-axial mandrels form both rims sequentially. The temperature and strain conditions were as in Example 2. The hot rolled wheels were then subjected to mechanical treatment, to form the finished wheel.

Example 8

Figure 2:
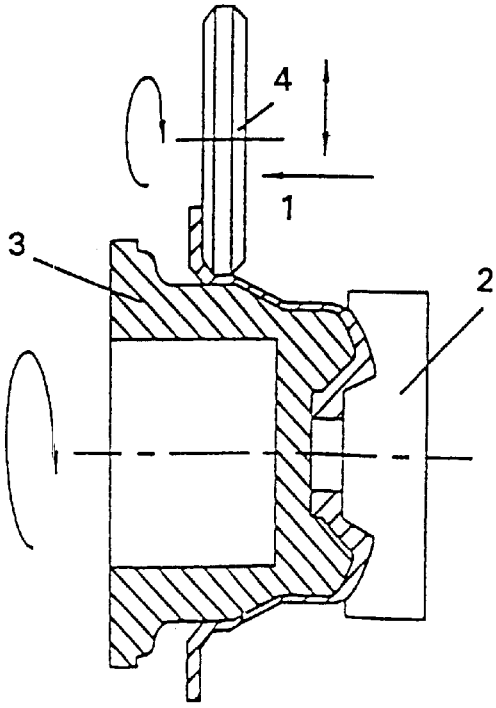
FIG. 2 illustrates a system for the hot rolling of a wheel block having a fine-grain microstructure in which the wheel block has a flange on the outer side.
Figure 3:
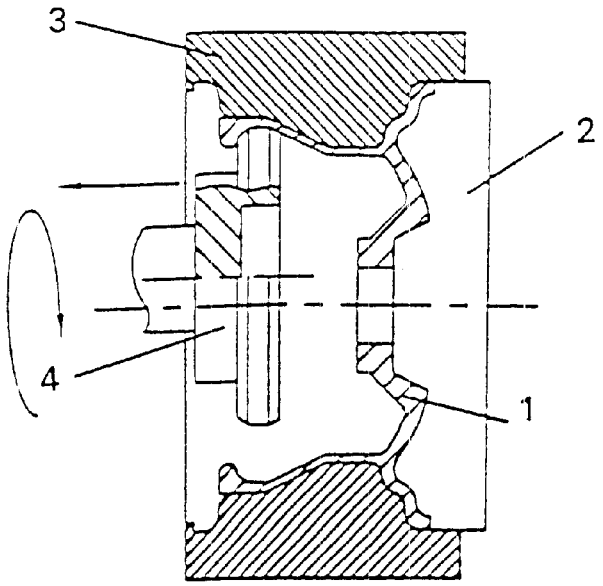
FIG. 3 illustrates a system for the hot, rolling of a wheel block having a coarse-grain microstructure in which the wheel block has a shoulder on the inner side.

The wheel blocks for hot rolling, as embodied by the invention, comprise 1420 alloy, and are formed with a wheel block rim as the conic flange or plate (see FIG. 10). The wheel block was manufactured by a hot forging process at a temperature of 420° C. with an average strain rate of $10^{-1}$ $s^{-1}$ to form a mixed-gain microstructure in the wheel block. About 40–60% of this microstructure comprised of fine gains with a size not more than 15 $\mu$m. A hot rolling process was performed in a single transition (step) on an outer side in one direction by disposing a projection of the rim onto the mandrel. The hot rolling process was conducted at a strain rate of $10^{-1}$–$10^{2}$ $s^{-1}$ and an average strain of 20% as illustrated in FIG. 2. The hot rolling time was 1.5 min. The hot rolled wheels were subjected to mechanical treatment, to result in the finished wheel.

While various embodiments are described herein, it will be appreciated from the specification that various combinations of elements, variations or improvements therein may be made by those skilled in the art, and are within the scope of the invention.

What is claimed is:

1. A method for manufacturing a wheel with a rim by hot rolling, comprising:

forming a wheel block into a configuration that comprises a central part of a wheel, intermediate parts, and a pre-formed rim; and drawing of the rim by hot rolling under temperature strain rate conditions which are determined by the wheel block microstructure.

2. The method of claim 1, comprising forming a coarse grain microstructure wheel block comprising a conic flange shaped rim.

3. The method of claim 1, comprising forming a coarse grain microstructure wheel block comprising a conic flange shaped rim and hot rolling at a first step on a conic mandrel and at a second step on a final shape mandrel.

4. The method of claim 1, comprising forming a coarse grain microstructure wheel block comprising a cylindrical shoulder shaped rim two to five time thicker than a finished wheel.

5. The method of claim 1, comprising forming a coarse grain microstructure wheel block and hot rolling at a strain rate less than $10^{-1}s^{-1}$.

6. The method of claim 1 comprising forming a coarse grain microstructure wheel block comprising a shoulder; and hot rolling the block on a mandrel to form a rim, wherein the shoulder diameter facing the mandrel differs from the mandrel diameter to provide a sliding interference fit of the wheel block to the mandrel to increase friction forces between the wheel block on the mandrel.

7. The method of claim 1, comprising forming a coarse grain microstructure wheel block comprising a shoulder; and hot rolling the block on a mandrel to form a rim, wherein the shoulder diameter facing the mandrel is at least 2% less than the mandrel diameter to provide a sliding interference fit of the wheel block to the mandrel to increase friction forces between the wheel block and the mandrel.

8. The method of claim 1, comprising forming a wheel block into a configuration that is determined according to a coarse microstructure comprising a grain size of at least 5,000 $\mu$m.

9. The method of claim 1, comprising forming a mixed grain microstructure wheel block comprising a combined shoulder, intermediate wheel portion and flange.

10. The method of claim 1, comprising forming a fine grain microstructure wheel block comprising a cylindrical shoulder shaped rim 1.1 to 1.5 times thicker than a finished wheel.

11. The method of claim 1, comprising forming a fine grain microstructure wheel block and hot rolling at a strain rate greater than $10^{-1}$ $s^{-1}$.

12. The method of claim 1, comprising forming a fine grain microstructure wheel block comprising a shoulder; and hot rolling the block on a mandrel to form a rim, wherein the shoulder diameter facing the mandrel differs from the mandrel diameter to provide a gap fit of the wheel block to the mandrel to decrease stress flow and increase rolling speed.

13. The method of claim 1, comprising forming a wheel block into a configuration that is determined according to a fine microstructure comprising an average grain size that does not exceed 15 $\mu$m.

14. The method of claim 1, comprising forging at 0.6 to 0.88 $T_{melt}$ and strain of 40–50% to form a wheel block comprising a rim with a cone-shaped flange and hot rolling of the rim at a temperature not higher than the temperature of forging and at a strain rate of $10^{-1}$–$10^{1}$ $s^{-1}$ to form a finished wheel, wherein the cone shaped flange is formed at an angle of inclination to its axis of 30°–45° and a thickness of 1.6 to 2.0 times greater than a thickness of the finished wheel.

15. The method of claim 1, comprising forging at 0.6 to 0.88 $T_{melt}$ and strain of 40 to 50% to form a wheel block comprising a combination of a flange and shoulder and hot rolling on two coaxial mandrels at a temperature that does not exceed the forging temperature and at a strain rate of $10^{-1}$ to $10^{1}$ $s^{-1}$.

16. The method of claim 1, comprising casting to from a wheel block comprising a rim with a cone-shaped flange and hot rolling the rim in a first transition at 0.6 to 0.88 $T_{melt}$ and strain rate of to $10^{-2}$ to $10^{-1}$ $s^{-1}$ down to a thickness of 1.1 to 1.5 and a second transition at a temperature not exceeding the first transition temperature and at a strain rate of at least $10^{-1}$ $s^{-1}$ to form a finished wheel, wherein the cone shaped flange is formed at an angle of inclination to its axis of 20° to 25° and a thickness of 2 to 2.5 times greater than a thickness of the finished wheel.

* * * * *

UNITED STATES PATENT AND TRADEMARK OFFICE

CERTIFICATE OF CORRECTION

PATENT NO. : 6,511,558 B1 
DATED : January 28, 2003
INVENTOR(S) : Farid Z. Utyashev et al.

It is certified that error appears in the above-identified patent and that said Letters Patent is hereby corrected as shown below:

Title page,
Item [73], please correct the Assignee as follows:
-- General Electric Company
Schenectady, New York
and
Institute of Metals Superplasticity Problems of the Russian Academy of Sciences,
Ufa, Russian Federation --

Signed and Sealed this

Twenty-ninth Day of April, 2003

JAMES E. ROGAN
*Director of the United States Patent and Trademark Office*